US005284375A

United States Patent [19]

Land, III

[11] Patent Number: 5,284,375

[45] Date of Patent: Feb. 8, 1994

[54] SINGLE ACTUATION ROD GRIPPING MECHANISM

[75] Inventor: J. George Land, III, Roanoke, Va.

[73] Assignee: Ingersoll-Rand Company, Woodcliff Lake, N.J.

[21] Appl. No.: 30,519

[22] Filed: Mar. 12, 1993

[51] Int. Cl.[5] ..... E21B 19/14

[52] U.S. Cl. ..... 294/88; 294/115; 414/22.71

[58] Field of Search ..... 294/88, 90, 106, 110.1, 294/112, 115, 116, 118; 414/22.51, 22.63, 22.71, 23, 745.1

[56] References Cited

U.S. PATENT DOCUMENTS

| | | | |
|---|---|---|---|
| 1,145,220 | 7/1915 | Smith | 294/112 |
| 1,851,923 | 3/1932 | McQuigg | 294/115 |
| 2,951,725 | 9/1960 | St. Jean | 294/115 X |
| 3,021,169 | 2/1962 | Harry | 294/115 |
| 3,071,405 | 1/1963 | Koehler | 294/88 |
| 3,094,349 | 6/1963 | Schwalm | 294/115 |
| 3,125,370 | 3/1964 | McGill | 294/115 |
| 3,156,496 | 11/1964 | Davidson | 294/88 |
| 3,198,567 | 8/1965 | Jongejan et al. | 294/115 X |
| 3,312,496 | 4/1967 | Boutelle et al. | 294/115 X |
| 3,469,879 | 9/1969 | Tezuka | 294/106 |
| 3,651,958 | 3/1972 | Evans et al. | 294/115 X |
| 3,938,846 | 2/1976 | Yuryan | 294/115 X |
| 3,938,847 | 2/1976 | Peyton | 294/115 X |
| 3,948,552 | 4/1976 | Hamrick | 294/115 |
| 4,304,433 | 12/1981 | Langowski | 294/88 X |
| 4,403,897 | 9/1983 | Willis | 294/88 X |
| 4,696,207 | 9/1987 | Boyadjieff | 414/22.71 X |
| 4,708,612 | 11/1987 | Pape . | |
| 4,744,596 | 5/1988 | Hiller et al. | 294/88 |
| 4,863,204 | 9/1989 | Peters | 294/115 X |

*Primary Examiner*—Johnny D. Cherry
*Attorney, Agent, or Firm*—John J. Selko

[57] ABSTRACT

A mechanism for gripping drill rods in a carousel of a drilling rig provides a dual function of extending and gripping in a single movement of a pair of opposed gripper arms pivotally connected to each other about a first, longitudinally movable pivot pin. A pair of opposed link arms is pivotally connected to each other about a second, fixed pivot pin, each link arm being also pivotally connected at an outer end to a gripper arm. A piston moves the pivot pin longitudinally in the housing, the gripper arms first spread apart from each other and then close toward each other, while simultaneously moving along the housing.

11 Claims, 5 Drawing Sheets

SINGLE ACTUATION ROD GRIPPING MECHANISM

BACKGROUND OF THE INVENTION

This invention relates generally to drill rigs and more particularly to drill rod gripping mechanisms used to grip and move drill rods from a storage carousel to the drill string of a drill rig.

Prior art drill rod changers of the kind that provide both an extend function and a grip function have a disadvantage in both drill change time and maintenance requirements. Having a separate extend and a separate grip function requires two sets of actuators and two sets of wear points to be maintained. The separate functions also require additional operator input twice during each rod change; once to extend the gripper into the carousel, and once to cause the gripper to grip the drill rod.

The foregoing illustrates limitations known to exist in present drill rod gripping mechanisms. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a drill rod gripping mechanism having a housing; a pair of opposed gripper arms pivotally connected to each other about a first pivot axis, which axis is longitudinally movable in the housing; a pair of opposed link arms pivotally connected to each other about a second, fixed pivot axis, each link arm being pivotally connected at an outer end to an adjacent gripper arm at a third and fourth pivot axis, respectively, all axes being parallel to each other and vertically perpendicular to the housing; means for moving the first pivot axis and gripper arms back and forth in the housing; and means for mounting the mechanism on a drill rig.

The foregoing and other aspects will become apparent from the following detailed description of the invention when considered in conjunction with the accompanying drawing figures.

BRIEF DESCRIPTION OF THE DRAWING FIGURES

FIG. 1 is a schematic plan view of a drill rod gripping mechanism in relation to a drill rod carousel and a drilling rig;

FIG. 2. is a perspective schematic view of a drill rod changer assembly using the invention;

DETAILED DESCRIPTION

Figure 1:
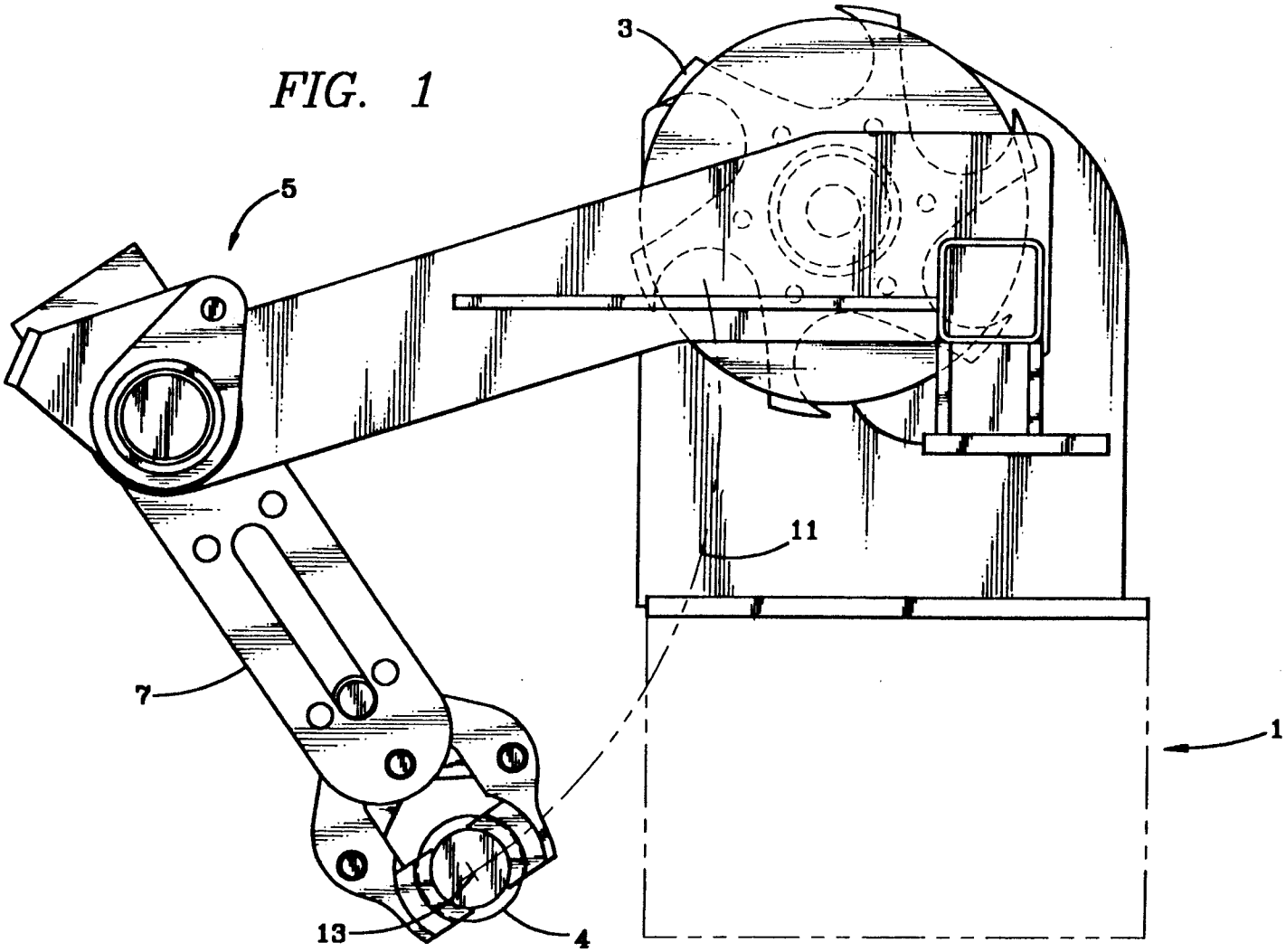
Figure 2:
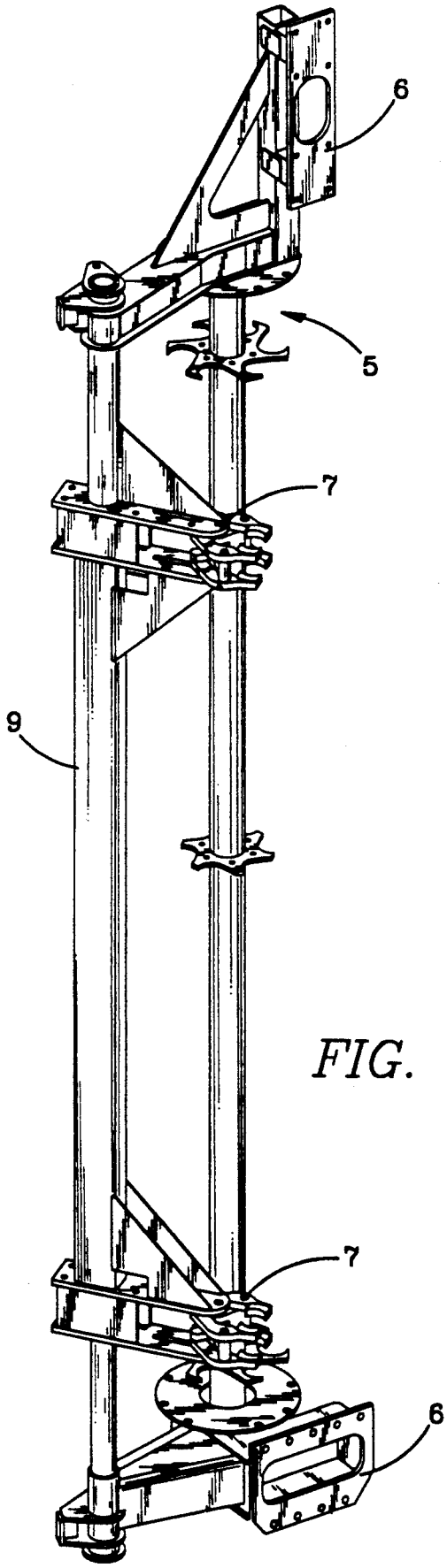

Now referring to FIGS. 1 and 2, there is shown, in phantom, the drilling rig generally as 1, with the carousel 3 of conventional design, for carrying drill rod 4.

Drill rod changer assembly 5 is connected to drilling rig 1 by well known means at connecting plates 6. Changer assembly 5 includes at least two drill rod gripping mechanisms 7 of the invention supported in spaced-apart relation along a support rod 9, which rod 9 is pivotally connected so that gripping mechanism 7 can pivot along an arc 11 (FIG. 1) to move the gripping end of mechanism 7 between carousel 3 and the centerline 13 of the drill rig, as is well known. The attachment of rod changer assembly 5 to drill rig 1, and the motive means for pivoting it along arc 11, are well known.

Referring to FIGS. 3–7, the gripping mechanism 7 of the invention includes a housing 20 extending longitudinally between an inner end 22 and an outer end 24. Housing 20 is formed by an upper and lower spaced-apart plate member 26, 28 and a pair of parallel spaced-apart side members 30, 32 all welded together to form a hollow, tubular housing. Upper plate member 26 has a retainer slot 34 extending longitudinally therein, and lower plate member 28 has a similar slot 36, parallel to slot 34, for a purpose described hereinafter.

A pair of opposed gripper arms 40, 42 are pivotally connected to each other around a first pivot axis 44 adjacent an inner end 46 of each gripper arm 40, 42. First pivot axis 44 is a pivot pin 50 having an upper end 52 and a lower end 54 slidably retained in slots 34 and 36, respectively. Pivot pin 50 is longitudinally movable in housing 20. By "longitudinally movable" I mean movable from start to finish in an overall relation that is longitudinal with respect to lengthwise extension of housing 20 between inner end 22 and outer end 24. I prefer movement of pivot pin 50 to be linear (straight-line) but it could be slightly arcuate, as long as the overall movement is longitudinal between inner end 22 and outer end 24.

A pair of opposed link arms 60, 62 (FIGS. 5–6) are pivotally connected to each other around a second pivot axis 64 adjacent an inner end 66 of each link arm 60, 62. Second pivot axis 64 is a pivot pin 68 having an upper end 70 and a lower end 72 retained in upper plate 26 and lower plate 28, respectively. Pivot pin 68 is fixed in housing 20, as regards longitudinal movement.

Each link arm 60, 62 is further pivotally connected at an outer end 80, 82 to an adjacent gripper arm 40, 42, respectively, at a third pivot axis 84 and a fourth pivot axis 86. Pivot axes 84, 86 are also pivot pins. Axes 84, 86 are positioned at a dogleg shaped portion of gripper arms 40, 42 for a purpose described hereinafter.

Figure 7:
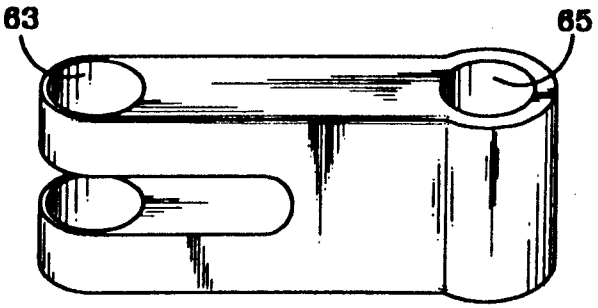
FIG. 7 is a perspective view of a link arm used in the invention.

FIG. 7 shows a detailed view of link arm 60, which is identical to link arm 62. Inner end 66 of each link arm is formed into pair of spaced-apart lugs 63 that are journaled around pivot pin 68, in an alternate relation, similar to a door hinge. Outer end 80, 82 of each link arm contains a single bore 65, and is journaled around pivot pin 84, 86, respectively.

Pivot axes 44, 64, 84, and 86 are all parallel to each other and extend vertically and perpendicular in relation to longitudinal extension of housing 20.

Figure 3:
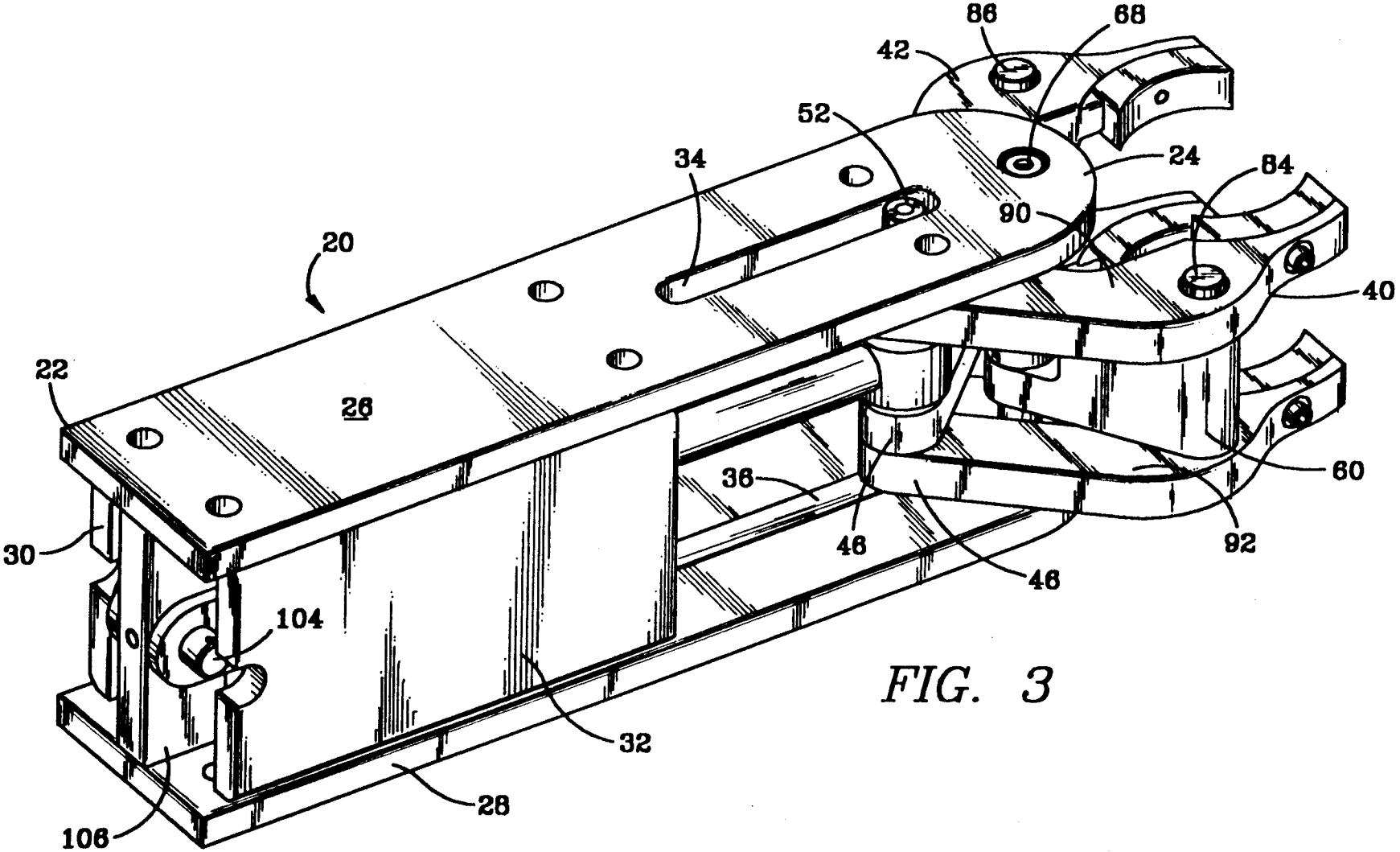
FIG. 3 is a perspective view of the gripping mechanism of the invention.
Figure 6:
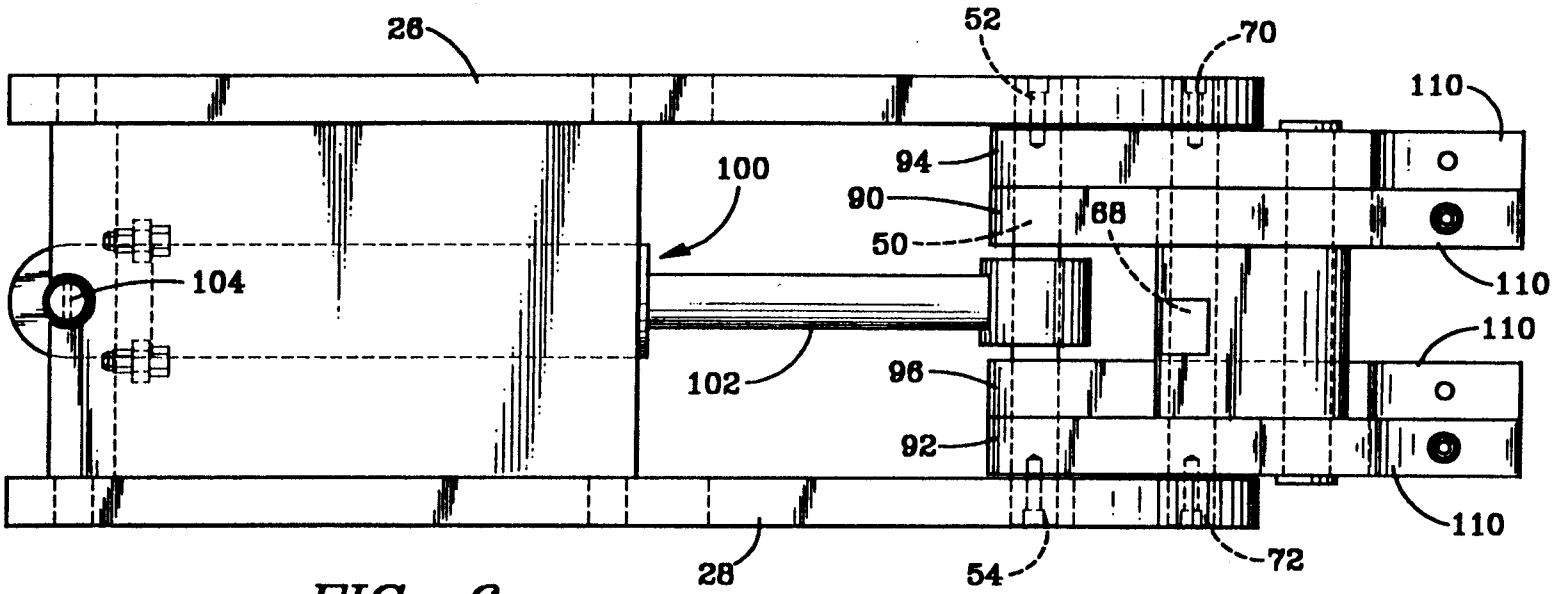
FIG. 6 is a side view of the invention in the extended position.

As shown in FIGS. 3 and 6, gripper arm 40 includes an upper and lower plate member 90, 92 spaced apart along pivot pin 50, with a link arm 60 positioned between plate members 90, 92. Likewise, gripper arm 42 includes an upper and lower plate member 94, 96 spaced apart along pivot pin 50, with a link arm 62 positioned between plate members 94, 96. I prefer that inner ends 46 of gripper arms 40, 42 are alternately stacked along pivot pin 50 to provide vertical compactness.

A conventional cylinder-piston combination 100 provides means for extending and retracting gripper arms 40, 42 longitudinally along housing 20. Movable piston rod 102 is pivotally connected to pivot pin 50, at its midpoint, and also pivotally connected at a rear portion 104 to a strut 106 extending between upper and lower plates 26, 28 . I prefer to position piston rod 102, first pivot axis 44, and second pivot axis 64 all in a common plane 108, vertically extending perpendicularly to longitudinal direction of housing 20. However, these elements can be positioned in planes that are slightly offset from each other, but parallel to plane 108.

Connected to the outer end of each gripper arm 40, 42 is a gripper pad 110, made from suitable abrasion resistant material. Gripper pad 110 is removably fastened as by bolting, for ease of replacement.

Figure 4:
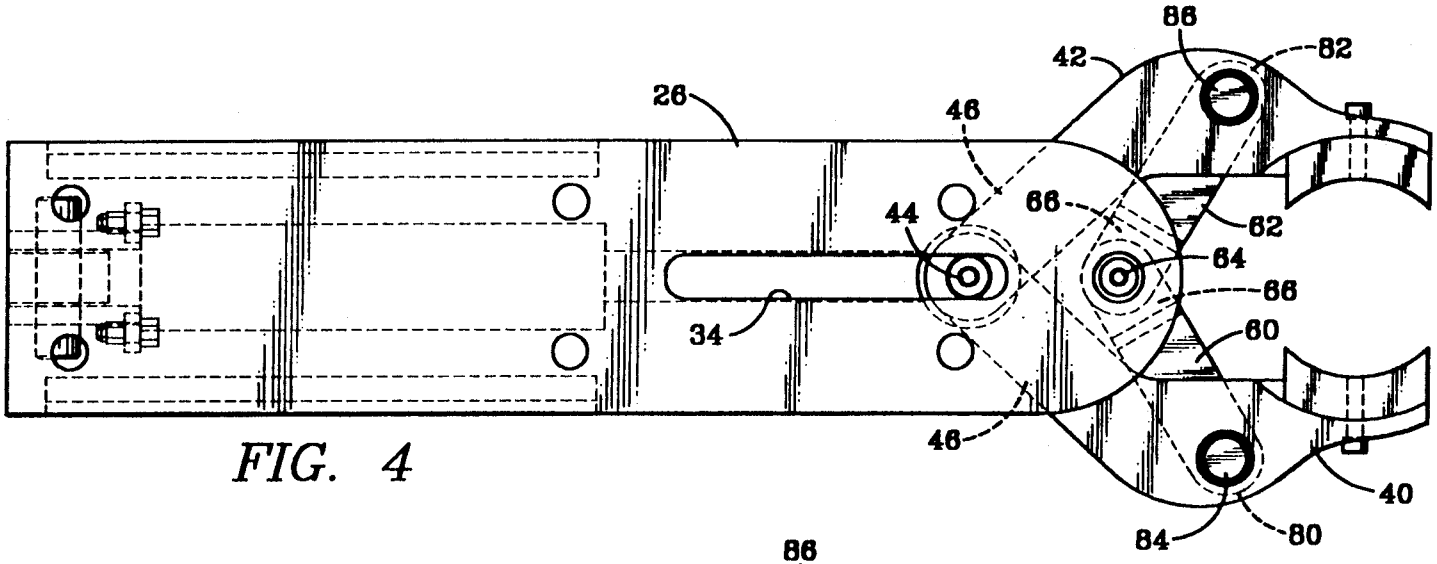
FIG. 4 is a top view of the invention in the extended position.
Figure 5:
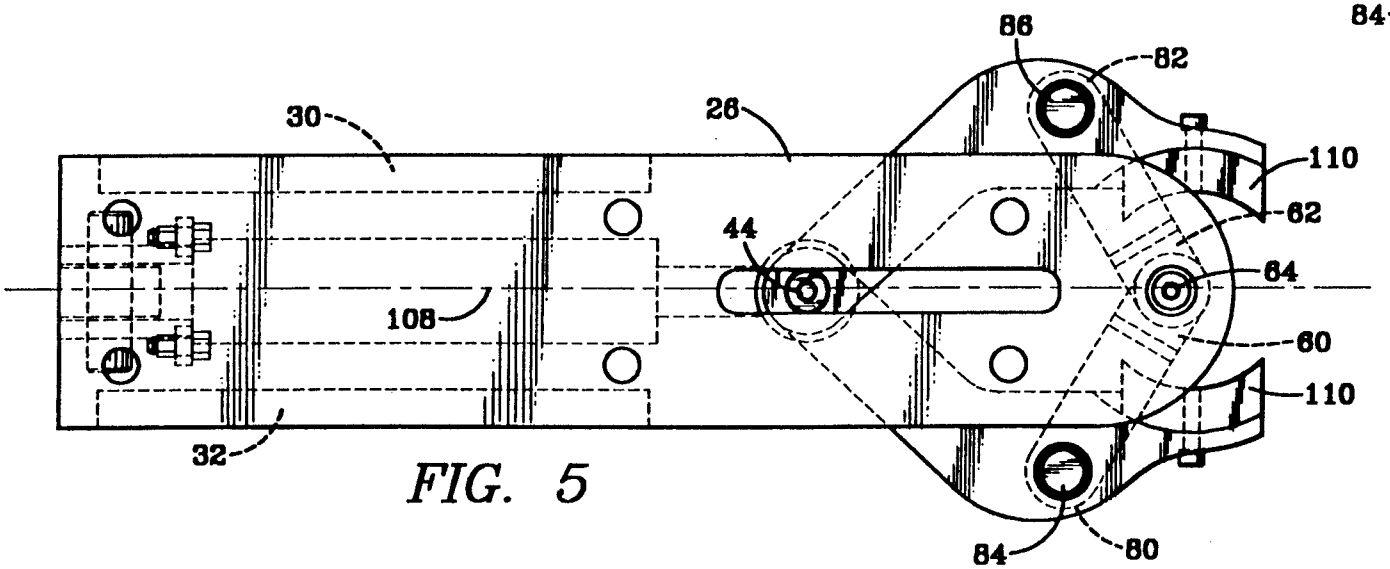
FIG. 5 is a top view of the invention in the retracted position.

Referring to FIGS. 4–5, the operation of the invention will be described. With the piston rod 102 in the retracted position, first pivot axis 44, and axes 84, 86 are positioned on one longitudinal side of fixed pivot axis 64. As rod 102 extends, pivot axis 44 moves linearly and longitudinally along housing 20. Simultaneously, gripper arms 40, 42 begin to spread apart from each other, and as pivot axis 44 continues to move, axes 84, 86 move, in a radial relation, outwardly around fixed pivot axis 64. Eventually, pivot axes 84, 86 become positioned on an opposite longitudinal side of fixed pivot axis 64, from the starting position. As this opposite position is reached, gripper arms 40, 42 begin to close toward each other, until the end of the piston stroke closes the gripper pads 110 around a drill rod. This radial movement of axes 84, 86 around fixed pivot axis 64 is achieved by the positioning of axes 84, 86 at a dogleg portion on each gripper arm, and is similar to an offset cam arrangement. Thus, during a forward movement, gripper arms 40, 42 move longitudinally along housing 20, while simultaneously first opening and then closing. During a reversed movement of axis 44, the reverse sequence of movement occurs. This motion provides both an extending function and a gripping/ungripping function in a single operator control stroke.

Having described the invention, what is claimed is:

1. A drill rod gripping mechanism for a drill rig comprising:

a. a housing extending longitudinally between an inner end and an outer end;

b. a pair of opposed gripper arms pivotally connected to each other around a first pivot axis adjacent an inner end of said gripper arms, said first pivot axis being longitudinally movable in said housing;

c. a pair of link arms pivotally connected to each other around a second pivot axis adjacent an inner end of said link arms, said second pivot axis being fixed in said housing, each link arm being pivotally connected at an outer end to an adjacent gripper arm at a third and fourth pivot axis, respectively;

d. said fixed pivot axis, said movable pivot axis, said third pivot axis and said fourth pivot axis being parallel to each other and extending vertically perpendicular to said housing;

e. means for longitudinally moving said first pivot axis and said gripper arms forward and back in said housing, whereby said gripper arms first open away from each other and thereafter close toward each other as said first pivot axis is moved forward; and f. means for pivotally mounting said housing on a drill rig.

2. The rod gripping mechanism of claim 1 wherein said movable pivot axis and said fixed pivot axis are positioned in a common vertical plane, with said fixed pivot axis being positioned adjacent said outer end of said housing.

3. A drill rod gripping mechanism for a drill rig comprising:

a. a housing extending longitudinally between an inner end and an outer end;

b. a first and second opposed gripper arm pivotally connected to each other around a first pivot axis adjacent an inner end of said gripper arms, said first pivot axis being vertically perpendicular to said housing and longitudinally movable in said housing;

c. a first and second opposed link arm pivotally connected to each other around a second pivot axis adjacent an inner end of said link arms, said second pivot axis being vertically perpendicular to said housing and fixed in said housing;

d. said first link arm pivotally connected at an outer end to said first gripper arm at a third pivot axis parallel to said first pivot axis;

e. said second link arm pivotally connected at an outer end to said second gripper arm at a fourth pivot axis parallel to said first pivot axis;

f. means for longitudinally moving said first pivot axis forward and back in said housing, whereby said gripper arms move longitudinally with respect to said housing, while said third and fourth pivot axes and said outer ends of said link arms move radially with respect to said fixed pivot axis, to cause said gripper arms to first open away from each other and thereafter close toward each other as said first pivot axis is moved forward; and g. means for pivotally mounting said housing on a drill rig.

4. The rod gripping mechanism of claim 3 wherein said movable pivot axis and said fixed pivot axis are positioned in a common vertical plane, with said fixed pivot axis being positioned adjacent said outer end of said housing.

5. The gripper mechanism of claim 3 wherein each gripper arm has connected to an outer end thereof gripper wear pad means for gripping drill rod.

6. The gripping mechanism of claim 5 wherein said third and fourth pivot axis is each connected to a gripper arm at a position whereby said third and fourth pivot axes are positioned on longitudinally opposite sides of said fixed pivot axis, when said gripper arms are fully extended and fully retracted, respectively.

7. The gripping mechanism of claim 6 further comprising:

a. said first gripper arm including an upper and lower plate member spaced apart on said third pivot axis, with said first link arm positioned therebetween; and b. said second gripper arm including an upper and lower plate member spaced apart on said fourth pivot axis, with said second link arm positioned therebetween.

8. The gripping mechanism of claim 7 further comprising;

a. said housing including an upper and lower spaced-apart plate member;

b. a retainer slot in both said upper and lower plate member, extending longitudinally along said housing; and c. said first pivot axis including a pivot pin having an upper and lower end slidably positioned and retained in said upper and lower plate member slots.

9. The gripper mechanism of claim 8 wherein said fixed pivot axis includes a pivot pin extending between said upper and lower plate members.

10. The gripper mechanism of claim 9 wherein said third and fourth pivot axis each includes a pivot pin extending through said upper and lower plate members and said link arms.

11. The gripper mechanism of claim 10 including piston-cylinder means movable longitudinally in said housing for longitudinally moving said first pivot axis.

* * * * *